United States Patent [19]

Appl et al.

[11] Patent Number: 4,995,550

[45] Date of Patent: Feb. 26, 1991

[54] VALVE METAL/PLATINUM COMPOSITE ELECTRODE

[75] Inventors: Herbert Appl, Krailing; Michael Gnann, Pfaffenhofen; Wolfgang Jahr, Wolfratshausen; Erwin Rossberger, Grossdingharting, all of Fed. Rep. of Germany

[73] Assignee: Peroxid-Chemie GmbH, Hoellriegelskreuth, Fed. Rep. of Germany

[21] Appl. No.: 380,155

[22] Filed: Jul. 13, 1989

[30] Foreign Application Priority Data

Jul. 13, 1988 [DE] Fed. Rep. of Germany ..... 3823760

[51] Int. Cl.[5] ..... H01M 4/58; B23K 20/22; B23K 101/36

[52] U.S. Cl. ..... 228/175; 228/190; 228/201; 228/214; 228/234; 228/237; 29/623.5; 429/218

[58] Field of Search ..... 228/214, 193, 190, 201, 228/202, 234, 243, 175, 237; 429/218; 29/623.5

[56] References Cited

U.S. PATENT DOCUMENTS

| | | | |
|---|---|---|---|
| 3,905,828 | 7/1986 | Barber | 429/218 |
| 4,762,268 | 8/1988 | Doble | 228/190 |
| 4,831,708 | 5/1989 | Yoshiwara et al. | 228/190 |

FOREIGN PATENT DOCUMENTS

| | | | |
|---|---|---|---|
| 28976 | 5/1981 | European Pat. Off. | 228/193 |
| 0245812 | 11/1987 | European Pat. Off. . | |
| 1188895 | 3/1965 | Fed. Rep. of Germany . | |
| 3639983 | 6/1988 | Fed. Rep. of Germany | 228/193 |
| 1600113 | 8/1970 | France . | |
| 2216046 | 8/1974 | France . | |

OTHER PUBLICATIONS

Metals Handbook Ninth Edition, "Solid State Welding", pp. 672-690, vol. 6, copyright 1983.

*Primary Examiner*—Sam Heinrich
*Attorney, Agent, or Firm*—Felfe & Lynch

[57] ABSTRACT

A composite electrode based on a valve metal with a layer of a platinum foil securely adhering thereto is produced by hot isostatic pressing of the valve metal base and platinum foil between separating sheets; the separating sheet which comes in contact with the platinum foil during hot isostatic pressing is a metal with a melting point of at least 100° C. above the hot isostatic pressing temperature.

27 Claims, No Drawings

VALVE METAL/PLATINUM COMPOSITE ELECTRODE

FIELD OF THE INVENTION

The present invention is concerned with a composite electrode for electrochemical purposes, a process for the production thereof and the use thereof for the anodic oxidation of inorganic and organic compounds, as well as an anode for galvanic baths.

The composite electrode according to the present invention is especially suitable for the production of peroxy compounds, for example peroxydisulphates, peroxymonosulphates, peroxydi- and monophosphates, peroxydicarbonates, perhalides, especially perchlorates, as well as of the related acids and of the hydrolysis products thereof.

BACKGROUND OF THE INVENTION

For anodic oxidation in electrochemical processes, because of its chemical properties, it is preferred to use platinum as anode material. Frequently, it is even the only metal which can be used for such processes.

Although platinum is very expensive, in the case of the electrochemical production of inorganic peroxy acids and of the salts thereof on a large scale, hitherto only massive platinum material has been used. It has, namely, been ascertained that even small amounts of alloying components, such as are used for the improvement of the mechanical strength of the platinum, for example of only 1% of iridium, reduce the current yield of the electrodimerization on the anode. The differing adsorption or desorption behavior of the metals for the anions or radicals and peroxy compounds on the anode surface are held to be responsible for this loss of energy. Also for the production of perhalides, especially of perchlorates and perchloric acid, there is also preferably used platinum since this, in comparison with other materials, for example graphite coated with lead dioxide, has a greater stability and thus a longer life.

Therefore, there is a need for composite electrodes of a base metal with a firmly adhering platinum covering. Composite electrodes are known in which the anode material platinum is fixed as a relatively thin covering on to a corrosion-resistant carrier material which has as good an electrical conductivity as possible. Thus, for example, it is known to produce a platinum covering by cathodic deposition from galvanic platinum baths or platinum salt melts. However, it has been shown that in such a composite material with a platinum layer applied galvanically on to a carrier material, for example on to titanium, the covering does not adhere sufficiently well to the carrier material when it is used as anode for electrolysis. Thus, when using such a composite electrode for the production of peroxydisulphates, only an insufficient period of use can be achieved.

It is also known to produce coatings of platinum by the thermal decomposition of platinum compounds. However, composite electrodes produced in this way only give low yields of peroxydisulphates or perchlorates. This applies especially to platinum oxide/mixed oxide coverings produced in this manner, such as are used for the electrolysis of alkali metal chlorides or for chlorate electrolysis.

Furthermore, all such thermally or galvanically produced platinum coverings for the anodic oxidation of inorganic and organic compounds, for example for the electrolytic production of peroxydisulphates or perchlorates, are too thin since, during the electrolysis, they undergo a wearing away which is so great that it amounts to one gram of platinum per ton of product. In large-scale plants, there is reckoned with a layer thickness loss of up to 5 μm. of platinum per year. The result of this is that, depending upon the nature of the electrolysis and of the technical carrying out thereof, massive platinum with a thickness of up to 100 μm. is employed.

The massive platinum used for the above-mentioned anodic processes is employed, for example, in the form of wires with a thickness of 120 to 150 μm. or as a rolled foil with a thickness of 10 to 100 μm. The electric current is thereby preferably passed through carrier metals on the platinum metal which are anodically stable in the electrolytes in question or are able to form a passive layer, i.e. so-called valve metals. The platinum itself is thereby fixed on to such carrier metals by means of various measures. Titanium, tantalum or zirconium is usually employed as carrier metal.

From Federal Republic of Germany Pat. No. 16 71 425, it is, for example, known firmly to screw a 50 μm. thick platinum foil on to a cylindrical hollow body by mechanical pressing on devices with a high local contact pressure, the substrate being titanium. However, in a composite produced in this manner, the current transfer from the titanium hollow body to the platinum foil takes place exclusively at those points on which the body and the foil are connected with one another by bearing pressure bands and rings. Since an oxidized titanium surface does not conduct current and thus represents an insulating layer, the transfer of the current to the electrochemically effective surface of the platinum only takes place through the thin cross-section of the platinum foil. The result of this is that this must be the thicker, the higher is the current density employed. In the case of continuous operation, such an electrode has a life time of up to 3 years. If the contact resistance between the titanium and the platinum foil increases too much, then the two parts must first be dismantled and the original state must be produced again by mechanical measures. However, this is no longer possible when, due to too high contact resistances, an oxidizing welding of the two parts has taken place in the electrolyte, which is very often the case.

A further problem lies in the fact that, due to frequent electrical flashovers which result from the poor current transfer from the anode tube to the platinum foil, not only the anode tube but also the platinum foil are increasingly more damaged with increasing period of use. Thus, under unfavorable conditions, the platinum foil of a tubular wound anode, such as is described, for example, in Federal Republic of Germany Pat. No. 16 71 425, can, due to a spark discharge to the underlying titanium hollow body, lift off or burn through locally. This leads to a subsequent short circuiting to the cathode surface which is only 3 to 6 mm. away and brings about a destruction of the cell. In extreme cases, this can lead to leakage of the whole electrolysis plant and even to the explosion of partial regions of the electrolyte pipe system.

It is also known to use for anodic electrochemical processes a tantalum-covered silver wire with a diameter of 1 to 2 mm. on which a long platinum wire is fixed spirally by point welding. In the case of another type of anode, on a titanium rod are fixed, by clamping or welding, platinum wires with projecting spokes on both sides, a planar anode covered with platinum wire thereby being formed.

However, all these composite electrodes have the disadvantage that the current passage from the carrier to the active electrode is poor, as a result of which the high current-loaded points of contact heat up and an increased corrosion thereby takes place at these points which, in turn, leads to an impairment of the conductivity and thus to a further heating up.

It is also known to fix a platinum foil to a carrier metal, for example tantalum or titanium, by roll seam welding. This is in part carried out by overlapping placing next to one another of welding points. However, in the case of such a welding process, in order to prevent the burning through of the foil in the case of the welding, the thickness of the platinum foil and of the carrier metal must be of the same order of magnitude. Thus, for example, for this purpose, a 40 μm. thick platinum foil must be used on 50 to 100 μm. thick tantalum. According to Federal Republic of Germany Pat. No.29 14 763, an improvement of the bonding is achieved by roll seam welding of a titanium sheet of 1 mm. thickness with a 10 μm. thick platinum foil and a stainless steel foil of 100 μm. thickness placed thereover, the stainless steel foil subsequently being removed again by chemically dissolving with an acid.

However, in such a welding process, the metallic and thus electrically-conducting connection is only guaranteed on the welding points. At the points not welded with one another, the platinum foil only lies on the carrier metal. The current transfer is there prevented so that a welded composite electrode of this type also displays the previously described disadvantages. Furthermore, these welding points are subjected to strong corrosion if the platinum foil is damaged and this can then result in a direct contact with the electrolyte.

However, the previously described disadvantages can be overcome by a planar contact between the platinum foil and the carrier metal. Thus, for example, it is known to apply an approximately 50 μm. thick platinum foil to a 2 mm. thick, pre-treated titanium sheet by roller plating. However, this process is expensive and, in addition, does not provide a dependable bonding since the metals do not attach to one another equally strongly at all points. Therefore, in the case of the use of such a material in electrolysis, it continuously happens that the platinum covering lifts off in places, a short circuiting to the counterelectrode thereby taking place.

Another possibility of forming a planar bonding between platinum foil and the carrier metal substrate consists in explosion plating. However, this has the disadvantage that a strong distortion, a considerable loss of material in the region near the edge and a fold or wave formation of the platinum foil must be taken into account, this laborious process thereby giving rise to further technical disadvantages. In addition, it is uneconomical.

Finally, it is also known to produce a planar bonding between a platinum foil and a carrier metal substrate by gas pressure diffusion welding (Ch. Nissel in Powder Metallurgy International, Vol. 16, No. 3, p. 13/1984). By hot isostatic pressing (HIP), there is thereby produced a firm mechanical bond between the two metals. However, it has been shown that only on small samples with a surface of a few $cm^2$ can a metal bonding be obtained which displays satisfactory results in the case of chlorine and chlorate electrolysis. Furthermore, the individual experimental results with regard to strength of adhesion and electrolysis properties are not reproducible. In particular, it has been shown that the cell voltage was different in all experiments. In the case of the production of peroxydisulphates, electrolysis current yields of 0 to 25% were measured with such composite metals.

OBJECT OF THE INVENTION

Therefore, it is an object of the present invention to overcome the above-described disadvantages of the prior art and to provide a composite electrode which is especially suitable for anodic oxidation, provides a high current yield and, furthermore, is characterized in operation by a long period of life.

DESCRIPTION OF THE INVENTION

We have found that a composite electrode of a valve metal base with a covering of platinum foil firmly adhering thereto is obtained by hot isostatic pressing of metal base and platinum foil between separating sheets when, for that separating sheet which in the case of hot isostatic pressing comes into contact with the platinum foil, there is used a metal not alloying with platinum with a melting point of at least 100° C. above the HIP temperature used or a metal foil provided with diffusion barriers.

Diffusion barriers are blocking layers which prevent the penetration of foreign materials, such as metal atoms or carbon, into the platinum metal. For the process according to the present invention, there are advantageously used diffusion barriers made of metal nitrides, sulphides, carbides and carbonitrides but preferably those made of metal oxides.

Instead of the metal, there can also be used a ceramic foil as separating sheet, which foil does not contain any carbon or compounds liberating carbon. However, it is necessary again completely to remove the ceramic particles pressed into the platinum surface. This can take place mechanically or chemically. For this purpose, at least 1 μm. and preferably at least 2 μm. must be removed from the platinum layer in order to remove all incorporated materials because it has been shown that particles incorporated into the platinum surface, for example ceramic fibres, reduce the current yield even though these are inert towards the platinum metal. In the process according to the present invention, all ceramic foils can be used which, under the process conditions, do not liberate any materials which chemically contaminate the platinum. We have found that long-lasting and, at the same time, especially effective composite electrodes are obtained when, under the above-defined process parameters, the platinum surface is kept completely free from a contact with such materials which alloy or mechanically contaminate the outerlying platinum surface. In particular, the outerlying platinum surface must thereby be kept away from carbon, silicon and those metals which alloy or react with the platinum surface and reduce the current yield of the anodic oxidation in favor of oxygen formation.

According to the process of the present invention, for the production of composite electrodes, sheets or foils of the separating material, base metal and platinum as covering metal are layered over one another and these layers are hot isostatically pressed with one another. As base metal, there is used a valve metal. For the production of a composite electrode with a covering on one side, there are laid on top of one another the individual layers in the sequence separating material/base metal/- platinum/separating material and for the production of a composite electrode with a double sided covering in the sequence separating material/platinum/base metal/-platinum/separating material. Each sequence thereby forms an element which gives a composite electrode. Usually, a stack of several such elements is formed. The height of the stack, as well as the surface of the foils and sheets, is only limited by the size of the autoclave oven in which the hot isostatic pressing is carried out. The stacking of the elements can take place in a rectangular or quadratic sheet metal box which is preferably made of stainless steel. However, other materials can also be used insofar as these are stable under the given process conditions. On the upper side of the stack is laid a foil of separating material. The upwardly open, preferably rectangular or quadratic box is subsequently tightly welded with a cover which consists of the same material as the box. Into the cover or in the side wall of the box is welded a thin tube through which a vacuum is applied to the interior of the box. Thereafter, the stump of the tube is clamped off and vacuum-tightly closed by welding. The layers lying on top of one another in the autoclave are then diffusion welded with one another by hot isostatic pressing. According to the present invention, the diffusion welding in the autoclave is carried out at a gas pressure of from 100 to 1200 bar and preferably of from 200 to 1000 bar and at a temperature of from 650° to 900° C. during the course of a period of time of at least 0.5 hours. It is preferred to press at a temperature of from 700° to 850° C. and over a period of time of from 0.5 to 5 hours and preferably of from 0.5 to 3 hours.

In the process according to the present invention, there are used separating materials cf fabrics of ceramic fibres, such as are obtainable, for example, for commercially available fire-resistant coverings. There is preferably used a ceramic fabric foil or a ceramic paper with a thickness of at most 1 mm. Such a separating material which is referred to as a separating sheet prevents the welding of the metals lying on both sides thereof. However, according to the present invention, only those ceramic separating materials are used which do not give off any materials impairing the electrochemical properties of the surface metal and, in particular, do not give off any materials which chemically contaminate the platinum. It has, namely, been shown that the commercially available separating fabrics contain small proportions of organic compounds which, in the case of heating in an autoclave to a temperature above 600° C., give off organic or carbon-containing vapors from which carbon deposits on the platinum surface which is alloyed into the platinum lattice. Therefore, according to the present invention, the separating fabric is, before the use thereof, freed from oxidizable carbon compounds and from carbon itself by calcining in an atmosphere of pure oxygen or in an atmosphere containing oxygen and especially in air at a temperature of from 600° to 700° C. However, in the case of using ceramic fabrics or papers, a partial inclusion of the ceramic fibres into the ductile platinum surface takes place which, however, can be removed by an after-treatment, for example with an alkali melt of potassium hydroxide or of a potassium hydroxide/sodium hydroxide mixture.

According to the present invention, instead of a ceramic fabric or paper, it is preferred to use a metal foil. However, there can thereby only be used those metals which, under the conditions of the hot isostatic pressing, do not alloy substantially or only a little with the base or with the covering metal. Small, microscopically thin alloy layers resulting by diffusion on the foils or sheets of platinum and separating metal lying on top of one another must again be removed mechanically, chemically or anodically after production of the metal composite. Conventional chemical after-treatment can be carried out, for example, by etching with, for example aqua regia, or also by anodic etching.

In the process according to the present invention, those metal foils are preferably used which contain a diffusion barrier. Such diffusion barriers can be produced by the formation of an oxide layer in a pure oxygen or oxygen-containing atmosphere, preferably in air, at a high temperature. The oxide layers are preferably produced by heating the metal foils to 400° to 800° C. and especially to 450° to 650° C. According to the present invention, as separating agent there is preferably used a molybdenum foil which is provided completely with an oxide layer, preferably by a thermal pretreatment at 450° to 600° C. in the air. Such a molybdenum foil provided with a diffusion barrier does not adhere either to the platinum or to the titanium after the hot pressing.

However, according to the present invention, there can also be used metals which have a diffusion barrier on their surface which consists of a nitride, sulphide, carbide or carbonitride layer. Such layers arc obtained by conventional reactions of the separating material with the appropriate reagents.

However, in the process according to the present invention, as separating agents there can also be used other metal foils, for example those of iron, nickel, tungsten, zirconium, niobium, tantalum, titanium or alloyed steel foils, especially low-carbon steel foils, such as AISI/1010, which are provided with appropriate diffusion barriers. The diffusion barriers are preferably produced by oxidation of the metals in air or oxygen.

However, it is also possible to use metal foils, for example of molybdenum or tungsten, without a diffusion barrier, i.e. without an oxidizing pretreatment. However, in such cases, the firmly adhering foil must then be removed chemically or electrochemically. If untreated metal foils, for example iron or nickel foils, are used, then, after the dissolving off thereof, there is obtained a roughened platinum surface which only has a smooth surface after a comparatively long electrolysis or after chemical or mechanical treatment. However, the use of firmly adhering but chemically non-dissolvable metal foils has the advantage that the platinum covering is protected in the case of the working up of the platinum/valve metal composite to give a finished electrode. Thus, for example, it is possible to produce the final form of the electrode by bending, rolling or deep drawing without thereby damaging the sensitive, ductile platinum surface. The dissolving off of the separating agent foil then first takes place on the finished electrode, possibly directly in incorporated form in the electrolysis. With a metal separation foil provided with a diffusion barrier, for example an oxidized metal foil, the composite electrode can easily be lifted off from the surface and can then again be used for the process according to the present invention. An electrode with good electrolysis properties can be achieved by especially smooth and shiny electrode surfaces such as are obtained by the use of an oxidized molybdenum foil in the process according to the present invention.

A separating agent layer of boron nitride, which is used in the form of a spray or suspension or as a powder, has also proved to be suitable.

By means of the process according to the present invention, electrodes are obtained which are inexpensive and stable and the use of which is not limited by those welding or contact points which limit the current flow to particular electrolysis current densities since the current introduction takes place via the whole of the pressed surface and, in addition, the thickness of the base or substrate metal is freely selectable. Therefore, contact overheatings, electrical flashovers or a high voltage drop, such as occur on the thin, massive platinum wire electrodes, are avoided. With the process according to the present invention, there can also even be produced large-surfaced electrodes for current densities of over 10 or even of over 100 $kA/m^2$ in the case of a simultaneously small use of platinum and a high stability.

We have found that the electrodes produced according to the present invention display a high current yield in the case of anodic oxidation. In the case of producing potassium persulphate by direct electrolysis, with, for example, electrodes produced by the process according to the present invention, with the use of calcined ceramic separating sheets, 15 minutes after the commencement of the electrolysis, there is achieved a current yield of 25 to 40% and in the case of the use of oxidized molybdenum foils as separating sheets, a current yield of 80% (as on massive platinum). In comparison therewith, with electrodes which have been produced by hot isostatic pressing with carbon-containing ceramic separating agents, there are only achieved current yields of from 0 to 25%.

The following Examples are given for the purpose of illustrating the present invention:

EXAMPLE 1

By bending and welding, from a stainless steel sheet (WST No. 1,4571) of 2 mm. thickness was produced a box of 50×50 cm. bottom surface area and 8 cm. height. In a cage-like holding means of heat-resistant steel with the internal dimensions of 45×45 cm. were stacked on top of one another 20 elements with the layer sequence of ceramic paper (of 95% aluminum oxide which had been previously calcined in the air at 700° C. for 1 hour) (manufacturer DMF Fasertechnik, Düsseldorf, Federal Republic of Germany; Type DK-Flex 16) 1 mm/titanium 3 mm/platinum foil 50 μm. and covered on the upper side with 1 mm. ceramic paper. The stack was covered with a cover of stainless steel and this was pressed until the edges of the cover and the side walls touched. The cover and the side walls of the box were welded with one another. Via an evacuation device (stainless steel tube of 5 mm. diameter and 50 mm. length and a wall thickness of 2 mm.), a vacuum was applied to the closed and welded box. After testing for tightness, the tube was closed by squeezing and welding.

The tightly closed box so prepared for the hot isostatic pressing was introduced into an autoclave oven. This was subjected to an argon pressure of 275 bar and heated for 0.5 hours to 700° C., the pressure thereby increasing to 980 bar. This state was maintained for 2 hours and then the oven was switched off, whereafter the overpressure was released. The cooling and decompression phase lasted about 1 hour.

The cooled box was cut open and the contents were removed. In this way, there were obtained composite electrodes coated on one side which, after mechanical after-treatment, for example by polishing, or after a chemical after-treatment by etching with aqua regia or anodic etching, gave, in the case of persulphate or perchlorate electrolysis, the same nominal current yields and voltages as in the case of massive platinum anodes.

EXAMPLE 2

For the production of titanium sheets covered on both sides with platinum foil, the procedure was as described in Example 1 but, as separating agent, there was used a commercially available molybdenum foil of 50 μm. thickness. Elements were formed as layers in the following sequence: titanium sheet 2 mm./platinum foil (50 μm.)/molybdenum foil 50 μm./ceramic paper 1 mm., a platinum foil thereby being used which was smaller than the titanium sheet. In this way, an edge of several mm. width was left free. Subsequently, as described in Example 1, hot isostatic pressing was carried out but at 700° C. and at 1000 bar. In the case of the metal composite obtained in this way, the molybdenum foil adhered not only to the titanium but also to the platinum and was dissolved off anodically with dilute sulphuric acid. In this way, there was obtained a high gloss platinum surface which was free from contaminations. It was found that, in the case of the process parameters used, no recognizable diffusion zone was formed between the molybdenum and the platinum.

EXAMPLE 3

Example 2 was repeated with the use of a 50 μm. thick steel foil AISI 1010 instead of a molybdenum foil. Under the thereby employed process parameters, a diffusion zone was formed between the iron and the platinum with a thickness of about 1 μm. The so obtained titanium/platinum/iron composite was formed into a tube analogously to Federal Republic of Germany Pat. No. 16 71 425 and welded with electrolyte inlet and outlet heads to give a finished anode. The iron layer was removed anodically with sulphuric acid and the platinum surface etched with aqua regia or mechanically polished.

EXAMPLE 4

A carefully degreased, 50 μm. thick molybdenum foil was heated in an oven in the air for 15 minutes to 550° C. a matt grey, thin oxide layer of very fine crystals thereby being formed. From this metal foil provided with a diffusion barrier, there was produced a layering of ceramic paper/titanium/platinum/molybdenum foil/platinum/titanium/ceramic paper, the foils and sheets thereby used corresponding to those of Examples 1 and 2. After the layering, hot isostatic pressing was carried out as described in Example 1 at 700° C. and at 1000 bar in an autoclave. The so obtained platinum-titanium composite sheet could easily be separated from the oxidized molybdenum foil. In this way, there was obtained an electrode with a smooth, shiny platinum surface which, in the case of persulphate electrolysis, immediately gave current yields as with a massive platinum sheet. After renewed oxidation, the molybdenum foil could be used again.

EXAMPLE 5

A steel foil AISI 1010 was heated in the air at 500° C. for 10 minutes, a violet-grey layer thereby being formed. The oxidized steel foil was used instead of the molybdenum foil for the production of a composite as described in Example 4. After the hot isostatic pressing, the work pieces could easily be separated. There was thereby obtained a black, roughened platinum surface which was etched with aqua regia before use.

EXAMPLE 6

Example 3 was repeated with the use of a nickel foil instead of a steel foil. A composite was thereby obtained which had a roughened platinum surface and which, after etching with aqua regia, gave an electrode which, in the case of persulphate electrolysis, gave yields like massive platinum.

EXAMPLE 7

A carefully degreased molybdenum foil was heated in the air at 500° C. for 15 minutes. With this molybdenum foil was produced a stack of elements consisting of layers in the sequence titanium/platinum/molybdenum-/aluminum oxide paper. Subsequently, hot isostatic pressing was carried out as described in the preceding Examples. The metal composite so obtained had a matt-glossy platinum surface and could be used for electrolysis without further pre-treatment.

EXAMPLE 8

A stack was produced which consisted of layers in the sequence 2 mm. stainless steel sheet 1.4539/2 mm. titanium sheet 3.7035/50 μm. platinum foil/1 mm. aluminum oxide ceramic paper which had been previously calcined at 1000° C. Subsequently, hot isostatic pressing was carried out as described in Example 1 but at 850° C. and 1000 bar for a period of 3 hours. The composite sheets thus obtained were arched and were rolled flat with a straightening roll. On to the stainless steel side was welded on a 10 mm. high projection with bridges and expanded metal. Ceramic fibre parts incorporated into the platinum were previously removed with the help of an alkali melt. The bipolar electrode thus obtained was used for persulphate electrolysis.

EXAMPLE 9

For the production of an electrode in which only a part of the surface was covered with platinum, a layering was produced with the use of a platinum mesh. Titanium/platinum mesh (52 mesh, wire 0.1 mm. diameter)/an oxidized molybdenum foil/aluminum oxide paper were thereby laid on top of one another and the stack produced was pressed in the manner described in Example 1. In this way, an electrode was obtained in which the base material was not completely provided with a platinum covering.

EXAMPLE 10

In the manner described in Example 1, a stack of layers of titanium 2 mm./tantalum 100 μm./platinum 50 μm./aluminum oxide paper 1 mm., was produced and the whole was hot isostatically pressed at 850° C. and 1000 bar. In this way, a platinum-tantalum electrode was obtained which was strengthened with cheap titanium.

In the following Examples, there is described the use of the electrodes according to the present invention in an electrolysis apparatus. For the determination of the anode behavior in potassium or sodium persulphate electrolytes, there was thereby used an undivided cell and for the determination of the anode behavior, in the case of sodium perchlorate electrolysis and in the case of the production of ammonium persulphate, a divided electrolysis cell was used. The electrolysis cells consisted of a PVC frame provided with inlet and outlet in which were fixed on one side the anode and on the other side the cathode via seals in such a manner that an electrode distance of 2 to 10 mm. was achieved, which corresponds to a technical electrolysis. In these laboratory electrolysis cells were used cathodes made from stainless steel which, like the anodes, had a rectangular surface of $2\times3$ cm$^2$ For divided cells, 2 PVC frames were used between which a separator was clamped by means of seals.

In the cells used, the electrolyte was passed through the whole electrolysis chamber with the us of an appropriate pump, for example Heidolph Krp 30. When divided cells were used, then the electrolyte was passed not only through the cathode chamber but also through the anode chamber. In this way, there was achieved a residence time of the electrolyte in the electrode gap of about 0.4 seconds. Due to the pump action, the mixture of gas and electrolyte resulting on the electrodes was passed upwardly and separated in a gas separator present thereabove. From the outlet of the separator, the electrolyte was then again passed into the intake pipes of the pump. The current yield was determined in the usual way by titrimetric determination of the anodically-formed compounds or by the gas analytical determination of the cell gas. For technical electrolyses, cells were used such as are employed in Federal Republic of Germany Pat. No. 16 71 425 for the electrolysis of potassium or sodium persulphate.

EXAMPLE 11

From a metal composite produced according to Example 4, with a platinum surface of $550\times260$ mm., was produced a tube electrode. This electrode was used in the case of a cell current of 1000 A for a precipitation electrolysis for the production of potassium persulphate. In an electrolyte with the composition 2.1 M sulphuric acid, 1.4 M potassium sulphate and 0.3 M potassium persulphate, of which 90% was suspended and 10% dissolved, there was thereby achieved a current yield of 75% in the case of a current density of 9 KA/m$^2$. This yield corresponded to that which hitherto could only be achieved with massive platinum foil anodes in the first half year of their running time. No corrosion could be ascertained on the platinum-titanium transition point lying open in the case of the electrolysis.

EXAMPLE 12

From the composite metal produced according to Example 4 was produced an electrode with a surface area of 6 cm$^2$ and this was used for the electrolysis of an electrolyte of 3.1M sulphuric acid and 2.8M sodium sulphate and an addition of thiocyanate for the production of sodium persulphate. The electrolysis was carried out in a cell at 20° C. and 5.4 A cell current (9 kA/m$^2$). In another cell, the same electrolyte was electrolyzed under the same conditions on a massive platinum sheet anode. Subsequently, the yields were determined by titration by means of known analysis processes. It was found that with the anode produced according to Example 4, as well as with the platinum sheet anode, there was achieved a persulphate yield of, in each case, 65%.

EXAMPLE 13

An ammonium persulphate electrolysis was carried out with a metal composite electrode produced according to Example 4 with an anode surface of 20 $cm^2$. With an electrolyte composition of 0.1M sulphuric acid, 2.6M ammonium sulphate, 0.9M ammonium persulphate and an addition of thiocyanate for the decomposition of Caro's acid, there was achieved a yield of 82% in the case of an electrolysis temperature of 40° C. The same yield was achieved with a comparison cell which was equipped with a massive platinum foil as anode.

EXAMPLE 14

In a membrane cell, the yields of the electrolytic formation of sodium perchlorate from sodium chlorate on composite electrodes produced according to Example 4 was compared with electrodes of massive platinum foil. In each case, the current density was 7 $kA/m^2$. In the case of an electrolyte starting concentration of 6.1M sodium chlorate at a pH value of from 6.5 to 7 and at a temperature of from 45° to 50° C., in both cases there was achieved a yield of 85%. With the composite electrodes according to the present invention, there were achieved the same current yields as are otherwise only achieved with massive platinum electrodes.

We claim:

1. A process for the production of a planiform composite electrode comprising a valve metal layer with a platinum layer securely adhering thereto by hot isostatic pressing of said valve metal layer and said platinum layer between separating sheets, wherein the separating sheet which comes in contact with the platinum layer during the hot isostatic pressing consists of a metal having a melting point of at least 100° C. above the hot isostatic pressing temperature.

2. A process of claim 1, wherein said separating sheet which comes in contact with the platinum layer during the hot isostatic pressing is a metal with a superficial diffusion barrier layer.

3. Process of claim 1, wherein said valve metal is a 0.1 to 10 mm thick sheet of titanium or tantalum.

4. Process of claim 1, wherein said platinum foil is 5 to 100 μm thick.

5. Process of claim 4, wherein said platinum foil is 20 to 50 μm thick.

6. Process of claim 1, wherein said platinum layers comprises wires, meshes or foil strips.

7. A process of claim 1, wherein the separating sheet which comes in contact with the platinum layer during the hot isostatic pressing consists of a metal having a melting point above 900° C.

8. A process of claim 1, wherein said separating sheet which comes in contact with the platinum layer during the hot isostatic pressing consists of iron, molybdenum, tungsten or nickel.

9. A process of claim 1, wherein the separating sheet which comes in contact with the platinum layer during the hot isostatic pressing consists of a metal foil or sheet with superficial oxide, nitride, sulfide, carbide or carbonitride layers.

10. Process of claim 7, wherein the superficial oxide layer is produced by oxidation in the air at a temperature of 400° to 800° C.

11. A process of claim 9, wherein said separating sheet is a nickel foil oxidized in the air at 720° to 780° C.

12. A process of claim 9, wherein said separating sheet is a molybdenum foil oxidized in the air at 500° to 550° C.

13. A process of claim 1, wherein the separating sheet which comes in contact with the platinum layer during the hot isostatic pressing consists of an oxidic or nitridic ceramic foil which, under the process conditions, does not liberate any carbon or materials which release carbon or chemically contaminate platinum.

14. A process of claim 1, wherein the separating sheet which comes in contact with the platinum foil during the hot isostatic pressing is removed mechanically, chemically or anodically after the production of the electrode in its ready-to-use form.

15. Process of claim 2, wherein the platinum surface, after the hot isostatic pressing, is removed chemically or mechanically in a layer thickness of at least 2 μm.

16. Process of claim 13, wherein said oxidic or nitridic ceramic foil is pre-calcined in the air in order to free it from carbon.

17. Process of claim 16, wherein precalcination is carried out at a temperature of 500° to 1000° C.

18. Process of claim 1, wherein said separating sheets comprise metal foils or sheets of high melting point metals, together with high melting point aluminum oxide fiber papers.

19. Process of claim 18, wherein a composite consisting of layers in the sequence oxidized molybdenum foil/platinum/titanium/nickel/aluminum oxide paper is hot isostatically pressed.

20. Process of claim 18, wherein a composite consisting of layers in the sequence oxidized molybdenum foil/platinum/titanium/steel or stainless steel-/aluminum oxide paper is hot isostatically pressed.

21. Process of claim 1, wherein the hot isostatic pressing is carried out at a temperature of 650° to 900° C. and at a pressure of 100 to 1200 bar.

22. Process of claim 21, wherein the hot isostatic pressing is carried out at a temperature of 700° to 800° C.

23. Process of claim 1, wherein hot isostatic pressing is carried out for a period of time of 0.5 to 3 hours.

24. A process of claim 19, wherein, after the hot isostatic pressing has taken place, a perforated sheet or lamellar sheet of expanded metal is welded onto the nickel layer as a pre-electrode.

25. A process of claim 20, wherein, after the hot isostatic pressing has taken place, a perforated sheet or lamellar sheet of expanded metal is welded onto the stainless steel layer as a pre-electrode.

26. A process of the production of a planiform composite electrode comprising a valve metal layer with a platinum layer securely adhering thereto by hot isostatic pressing of said valve metal layer and said platinum layer between separating sheets, wherein said separating sheets are mats, fabrics, fibrous papers, plates or foils or oxides or oxide ceramics of aluminum oxide or of mixtures of silicon dioxide and aluminum oxide or of high melting point laminar silicates.

27. Process of claim 26, wherein said laminar silicate is mica.

* * * * *

UNITED STATES PATENT AND TRADEMARK OFFICE

CERTIFICATE OF CORRECTION

PATENT NO. : 4,995,550

DATED : February 26, 1991

INVENTOR(S) : Herbert Appl et al

It is certified that error appears in the above-identified patent and that said Letters Patent is hereby corrected as shown below:

Column 6, line 28, "arc" should read --are--.

Column 11, line 62, "7" should read --9--.

Signed and Sealed this

Twenty-seventh Day of October, 1992

*Attest:*

DOUGLAS B. COMER

*Attesting Officer*

*Acting Commissioner of Patents and Trademarks*